US006819033B2

(12) United States Patent
Kanao et al.

(10) Patent No.: US 6,819,033 B2
(45) Date of Patent: Nov. 16, 2004

(54) SPARK PLUG AND METHOD OF MANUFACTURING SAME

(75) Inventors: Keiji Kanao, Aichi-ken (JP); Masayuki Tamura, Anjo (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/212,228

(22) Filed: Aug. 6, 2002

(65) Prior Publication Data

US 2003/0038578 A1 Feb. 27, 2003

(30) Foreign Application Priority Data

Aug. 22, 2001 (JP) ..... 2001-251895

(51) Int. Cl.[7] ..... H01T 13/20
(52) U.S. Cl. ..... 313/141; 313/143; 445/7
(58) Field of Search ..... 313/140, 141, 313/144, 143, 118; 445/7

(56) References Cited

U.S. PATENT DOCUMENTS 4,401,915 A * 8/1983 Kashiwara et al. ..... 313/142
4,967,116 A * 10/1990 Oshima ..... 313/141
5,210,458 A * 5/1993 McDougal ..... 313/130
6,109,504 A * 8/2000 Groll ..... 228/107

FOREIGN PATENT DOCUMENTS

JP 8-236263 9/1996
JP 2001-68250 3/2001

* cited by examiner

*Primary Examiner*—Edward J. Glick
*Assistant Examiner*—Elizabeth Keaney
(74) *Attorney, Agent, or Firm*—Nixon & Vanderhye PC

(57) ABSTRACT

A spark plug comprises a main metal fitting, a center electrode mounted to and held by the main metal fitting in a manner insulated therefrom and a grounding electrode having one end welded to the main metal fitting and another end opposing to the center electrode. A welding burr is further formed to the welded portion of the main metal fitting and the grounding electrode so as to have an area expanding outside the grounding electrode, and the main metal fitting of the main metal fitting is plated, whereas the grounding electrode and the welding burr are not plated.

10 Claims, 5 Drawing Sheets

SPARK PLUG AND METHOD OF MANUFACTURING SAME

BACKGROUND OF THE INVENTION

The present invention relates to a spark plug carrying out a spark discharge between a center electrode and a grounding electrode and also relates to a method of manufacturing such spark plug.

A spark plug is generally utilized under a sever thermal condition (high thermal load), and hence, in order to suppress spark consumption due to progressing of internal oxidation of the grounding (ground or earthing) electrode, a nickel (Ni-)base alloy such as Inconel (Trade Mark Name) having an excellent heat resisting and acid-proof property has been utilized for a material of the grounding electrode. On the other hand, a main metal fitting (metal element) holding, in an insulated manner, the central electrode is generally formed of a low carbon steel.

The main metal fitting of the low carbon steel is effected with plating for the purpose of corrosion protection such as disclosed, for example, in Japanese Patent Laid-open Publication No. 1996-236263, which provides a spark plug with improved heat resistance by carrying out plating after the grounding electrode has been welded to the main metal fitting. The grounding electrode is preliminarily bent to prevent cracking before the plating treatment from causing. Furthermore, Japanese Patent Laid-open Publication No. 2001-68250 also provides a spark plug and a manufacturing method thereof and discloses that a main metal fitting and a grounding electrode are integrated, and in this state, zinc plating is effected thereto except a tip end portion of the grounding electrode or the grounding electrode side is masked and the main metal fitting is plated after the welding of the main metal fitting to the grounding electrode. Thereafter, the zinc plating (plated) layer formed to the tip end side of the grounding electrode is peeled and removed, and the thus exposed surface is then welded with a high melting point metal to thereby form an ignition portion.

However, in the case that the main metal fitting and the grounding electrode are plated after the welding, when the grounding electrode is bent for the adjustment of a gap between the center electrode and the grounding electrode, there may cause a case that the plated layer or film on the grounding electrode may be peeled off and the center electrode and the grounding electrode are short-circuited through the peeled plating film or layer, which may cause a flame-off (misfire) phenomenon.

On the other hand, in the case that the masking is effected to the grounding electrode after the welding process, since the grounding electrode is not completely covered by the masking, there causes a fear that a plated film or layer having a height of about 1–2 mm adheres on the welded side end of the grounding electrode (such as shown in FIG. 2). In such case, the adhering plated layer is peeled by a thermal stress during engine operation and flying sparks or lifted flame may occur, causing a fear of an ignition failure.

Moreover, in advancing technology in which a life time of the spark plug is elongated, there is a fear of causing peel-off of the plated layer in a long time use even if little amount of the plated layer remains.

SUMMARY OF THE INVENTION

An object of the present invention is to substantially eliminate defects or inconveniences encountered in the prior art mentioned above and to provide a spark plug having an improved structure capable of surely preventing flame-off or ignition failure caused by peeling off the plated layer or film on a grounding electrode.

This and other objects can be achieved by providing a spark plug comprising:

a main metal fitting;

a center electrode mounted to and held by the main metal fitting in a manner insulated therefrom; and a grounding electrode having one end welded to the main metal fitting and another end opposing to the center electrode, wherein a welding burr is formed to the welded portion of the main metal fitting and the grounding electrode so as to have an area expanding outside the grounding electrode, and only the main metal fitting is plated, and the grounding electrode and the welding burr are not plated.

According to this aspect, since the main metal electrode is plated, the main metal fitting can be prevented from corroding and, on the other hand, since the ground electrode and the welding burr are not plated, misfire or ignition failure caused by the peeling of a plated layer or film formed to the grounding electrode, as in the conventional structure, can be effectively prevented from causing.

In a preferred embodiment of the above aspect, the main metal fitting is plated at a portion except for the welded portion, and the welded portion includes a non-plating (non-plated) portion which is entirely covered by the grounding electrode and the welding burr. The non-plating portion of the main metal fitting is formed by once effecting the plating treatment to the entire surface of the main metal fitting and then peeling, by polishing, the plated layer of a portion which is welded thereafter to the grounding electrode. The non-plating portion of the main metal fitting may be formed by effecting a masking treatment to the main metal fitting. The grounding electrode may be preferably formed from an Ni-base alloy.

According to such preferred embodiment, since only the portion to be welded of the main metal fitting is plated, the welding strength between the main metal fitting and the grounding electrode can be ensured in addition to the prevention of the corrosion to the main metal fitting. The welding burr covers the non-plated (non-plating) portion of the main metal fitting, so that the corrosion of the non-plated portion can be prevented. The use of the Ni-base alloy for the grounding electrode makes free from plating.

In a further preferred embodiment, the welded portion includes a non-plating portion and S/A value is in a range of $0.7 \leqq S/A \leqq 1.5$ in which symbol S is an area of the non-plating portion of the main metal fitting and symbol A is an area of the welded side end surface of the grounding electrode.

In the case where the area S of the non-plating portion is too small, it is difficult to ensure a necessary welding strength, and the grounding electrode is hence easily peeled off from the welding interface at the time of adjusting the spark gap. In the examination of the inventor, it was found that the necessary strength could be ensured by setting the S/A value to $0.7 \leqq S/A$.

On the other hand, in the case where the area S of the non-plating portion is considerably larger than the welding side area A of the grounding electrode, in order to cover the non-plating portion with the grounding electrode and the welding burr, it is necessary to make large the welding burr by excessively setting the welding condition. However, it was found that when the welding burr becomes excessively large, a horizontal flying spark was easily generated to the welding burr. It was also found that such defect could be effectively eliminated by setting the S/A value to S/A≦1.5.

In another aspect of the present invention, there is also provided a method of manufacturing a spark plug including a main metal fitting, a center electrode supported by the main metal fitting in a manner insulated therefrom and a grounding electrode having one end to which the main metal fitting is welded and another end opposing to the center electrode, wherein, only the main metal fitting is plated to a portion except the portion to be welded to the grounding electrode and said grounding electrode is then welded to the main metal fitting.

In a preferred embodiment of this aspect, the welding is effected under oxygen free atmosphere.

According to this aspect, oxidation coloring which may be caused at the welding time can be prevented.

Furthermore, substantially the same advantageous functions and effects as those mentioned above with reference to the preferred embodiment of the spark plug of the present invention can be achieved also by this manufacturing method.

The nature and further characteristic features of the present invention will be made further clear from the following descriptions made with reference to the accompanying drawings.

DESCRIPTION OF THE PREFERRED EMBODIMENT

A preferred embodiment of a spark plug of the present invention will be described hereunder with reference to the accompanying drawings.

Figure 1:
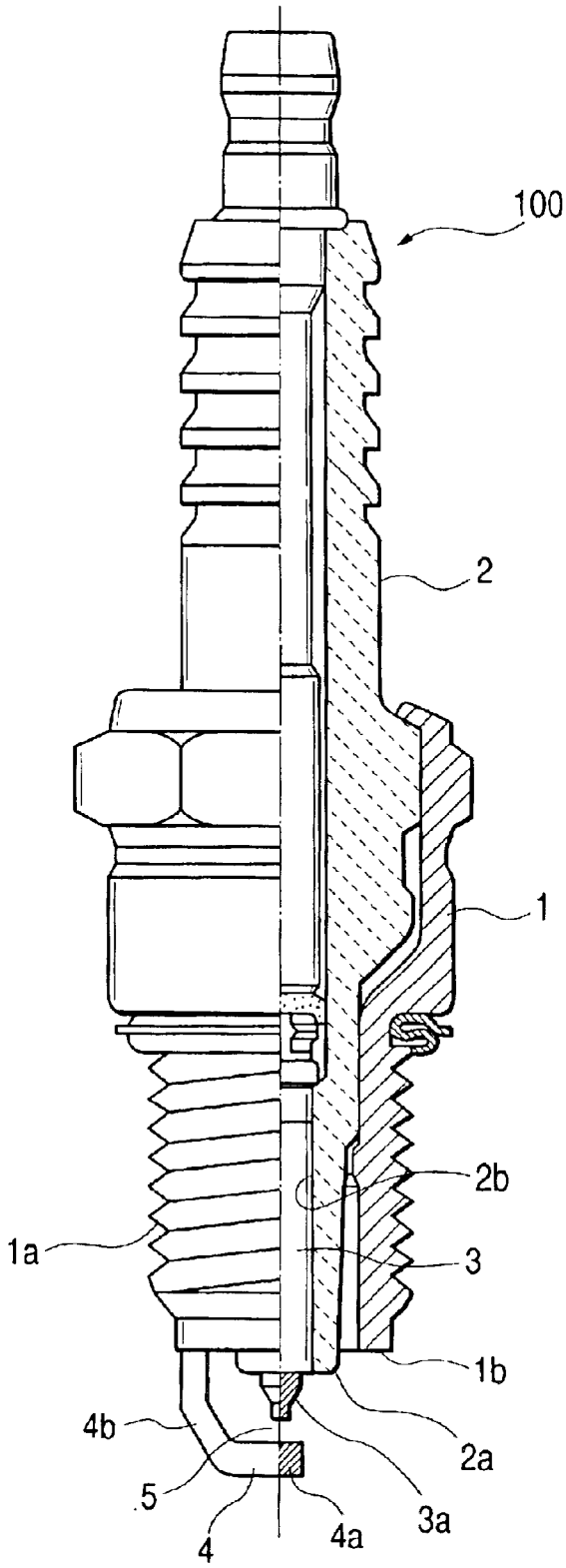
FIG. 1 is an elevational front view, half in section, of a spark plug according to an embodiment of the present invention.

With first reference to FIG. 1 showing a spark plug, right half in section, a spark plug 100 generally comprises a main metal fitting 1, a center electrode 3 and a grounding or ground electrode 4. The main metal fitting 1 has a tubular structure formed, for example, of a conductive iron steel material such as low carbon steel. The main metal fitting 1 is formed with a screw (threaded) portion 1*a* for mounting and securing the spark plug 100 to a cylinder block of an engine, not shown, of an automobile, for example. An insulating material (insulator) 2 formed from an alumina ceramic ($Al_2O_3$) or like is disposed and secured inside the main metal fitting 1. The insulating material 2 has a front end portion 2*a* (lower end side as viewed) on the side of a combustion chamber of the engine, not shown, is exposed from the main metal fitting 1.

Further, it is to be noted that terms "upper", "lower", "front" and the like are used herein with reference to the illustration of the accompanying drawings, or with the grounding electrode side being the front side of the spark plug.

The center electrode 3 is held and secured to a shaft hole 2*b* formed to the insulator 2 so as to be held by the main metal fitting 1 through the insulator 2 in the insulated manner, and a front end portion 3*a* of the center electrode 3 on the side of a combustion chamber of the engine is exposed through the front end portion 2*a* of the insulator 2. The center electrode 3 is formed from metal material so as to provide a tubular structure having an inner member formed from a metal material such as Cu having an excellent heat conductivity and an outer member formed from a metal material such as Ni-base alloy having an excellent heat-resisting and acid-proof property.

On the other hand, the grounding electrode 4 is joined to an end surface 1*b* (lower end as viewed in FIG. 1) of the main metal fitting 1 on the engine combustion chamber side through a resistance welding process so as to extend downward as viewed. The extending portion of the grounding electrode 4 is bent, at its intermediate portion, in L-shape, and the front end portion 4*a* thereof, opposing to the welded end, faces the front end portion 3*a* of the center electrode 3 through a discharge gap 5. The grounding electrode 4 is formed of an Ni-base alloy excellent in heat-proof and acid-proof property, and more specifically, formed of Inconel 600 (Trade Mark name) consisting of Ni (main component), Cr (15 weight %) and Fe (7 weight %).

An endurance (durability) test of spark plugs was carried out to measure frequency of occurrence of horizontal flying sparks. These spark plugs were prepared by forming plating layers M, adhering to the welded side end portion 4*b* of the grounding electrode 4, having height (i.e., thickness) L in the range of 0 to 2 mm, as shown in FIG. 2.

The endurance test was carried out by using an engine having six-cylinder and displacement of 2000 cc. The engine was operated at 6000 rpm for 1 minute in a driving operation and at 650 rpm for 1 minute at idling operation, and these operations were repeated for 100 hours.

Figure 2:
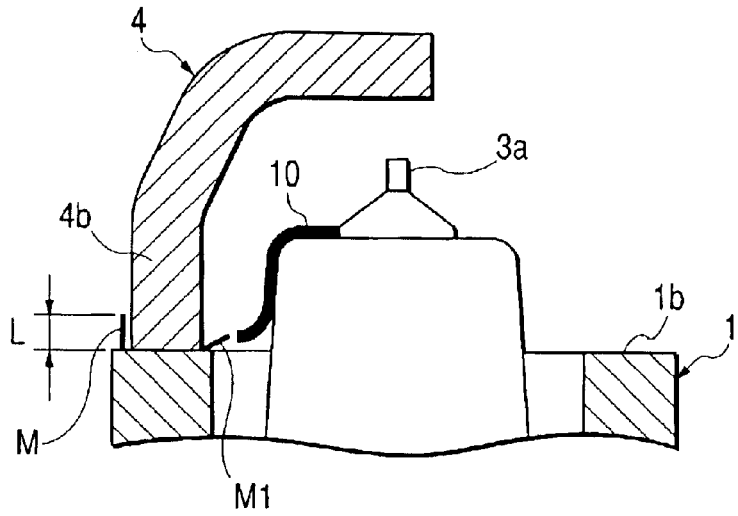
FIG. 2 is an illustrated sectional view of a grounding electrode of a spark plug used for an experiment.

In such endurance test, the plating layer was peeled off as designated by M1 in FIG. 2 by the thermal stress, and the frequency of the occurrence of the horizontal flying sparks was examined as influence of the peeling-off of the plated layer. The horizontal flying spark occurrence frequency was measured under the conditions that a spark plug after the endurance test was mounted to a container an inner pressure of which was set to 0.8 MP with spark discharge of 30 Hz.

Figure 3:
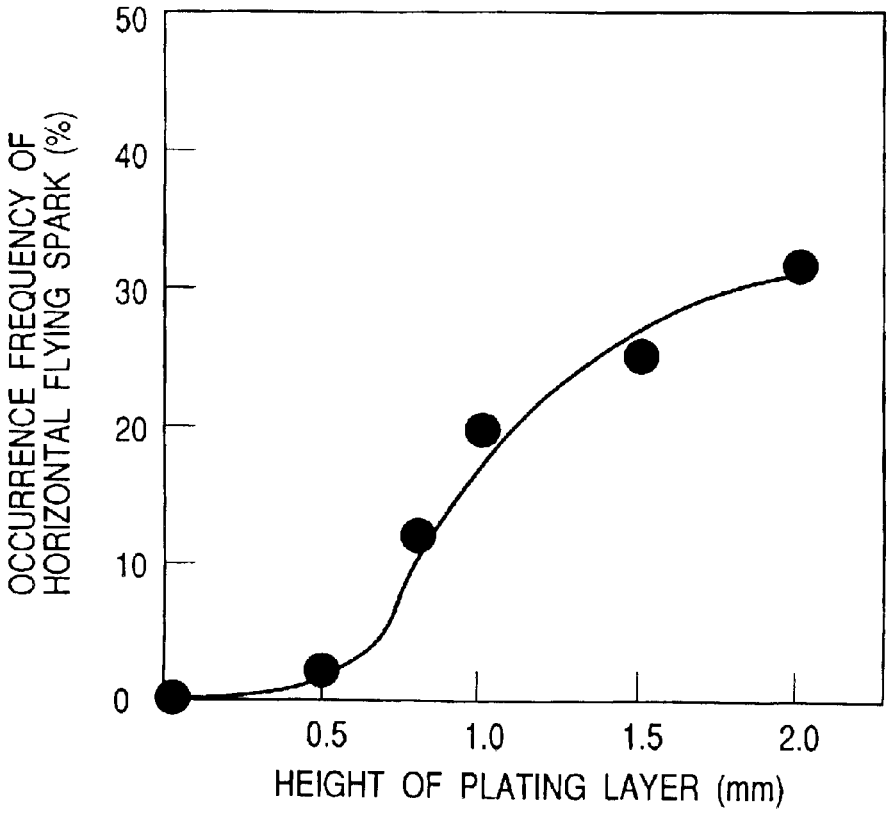
FIG. 3 is a graph showing a relationship between a height of a plating (plated) layer and an occurrence frequency of lifted flame.

The result of this measurement is represented by a graph of FIG. 3. In view of this test result, it was found by the inventor of the subject application that a spark plug provides no problem or defect in a practical use in the case that the occurrence frequency of the horizontal flying spark is less than 10%, and accordingly, that the height of the plating layer L is less than 0.5 mm. However, in a conventional technology in which the grounding electrode 4 is masked and the main metal fitting 1 is plated, it was difficult for the plating layer to make a height less than 0.5 mm.

Figure 4:
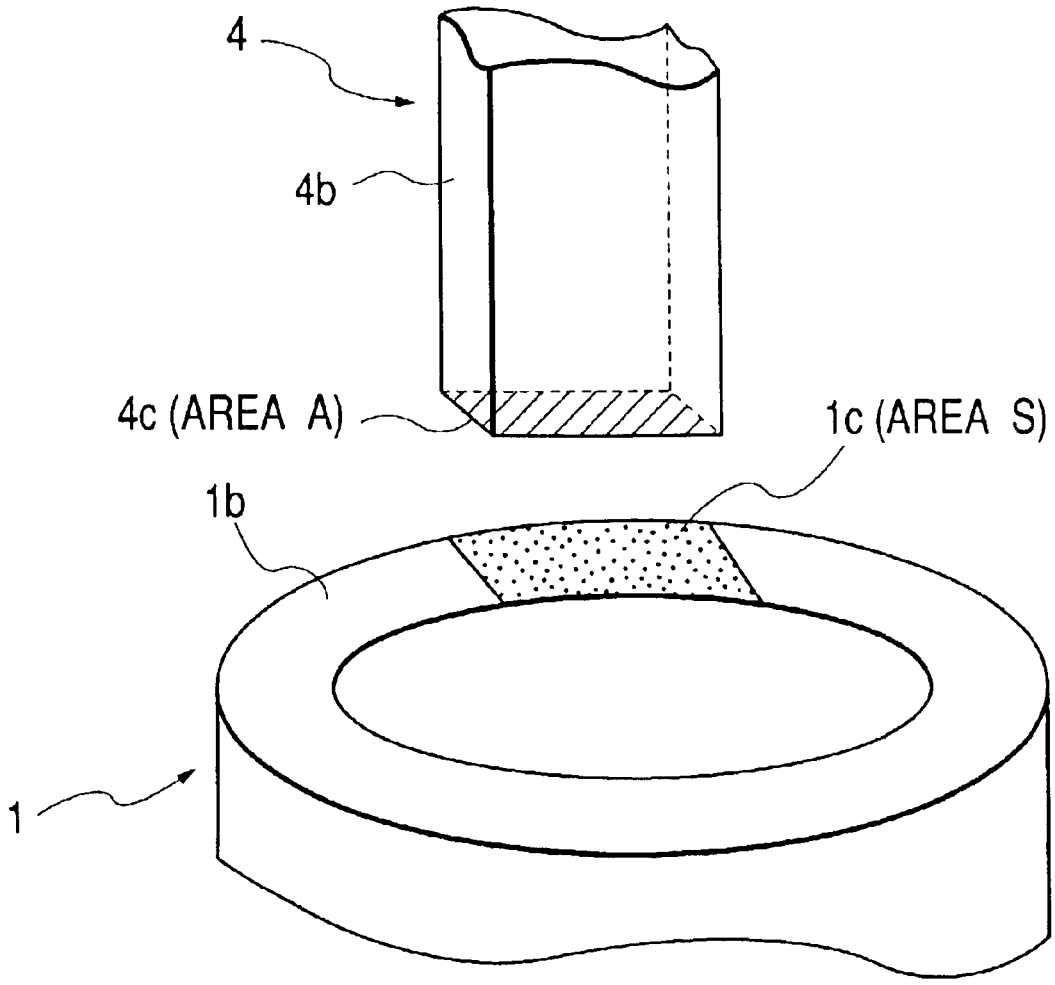
FIG. 4 is a developed perspective view showing an essential portion of the spark plug used for the experiment.

In view of the above defect of the conventional technology, according to the embodiment of the present invention, the entire surface of only the main metal fitting 1 is plated, and thereafter, as shown in FIG. 4, the plating layer formed to the end surface 1*b* of the main metal fitting 1, to which the grounding electrode 4 is welded, is peeled off by means of polishing, for example, so as to provide a non-plated portion 1*c*. The grounding electrode 4, which was not subjected to the plating process, is welded to this non-plated portion 1*c* of the main metal fitting 1.

According to the method of manufacturing the spark plug of the present invention mentioned above, the spark plug formed with no plating layer to the grounding electrode can be manufactured. Therefore, in the use of such spark plug of which grounding electrode has no plating layer, there will not occur any misfire or ignition failure, as in a spark plug of a conventional structure, which is caused by the peeling-off of the plated layer of the grounding electrode. Further, since the other portion of the main metal fitting is covered by the plating layer, the corrosion thereof can be effectively prevented.

Incidentally, with reference to FIG. 4, in a case where an area S of the non-plated portion 1*c* of the main metal fitting 1 is too small with respect to an area A (shown with oblique lines) of the welding side end surface 4*c* of the grounding electrode 4, it is difficult to sufficiently ensure a necessary welding strength, and in such defective case, the grounding electrode 4 is easily peeled and removed from the welding surface to the main metal fitting 1 at the time of spark gap adjustment.

In consideration of the above matter, the inventor of the subject application examined the relationship between the welding strength and the S/A value (S: area of the non-plated portion of the main metal fitting and A: area of the welding surface of the grounding electrode).

For this purpose, there was prepared a spark plug under the condition that the main metal fitting 1 and the grounding electrode 4 were resistance-welded under oxygen free atmosphere (more specifically, in an inactive gas such as Ar gas), wherein the area A of the welding side end surface 4*c* of the grounding electrode 4 was set to 4.2 $mm^2$ (thickness and width of the grounding electrode 4 was 1.6 mm×2.8 mm) and the area S of the non-plated portion 1*c* of the main metal fitting 1 was set to various values. The thus prepared spark plug was subjected to a tensile (pull) strength test.

Figure 5:
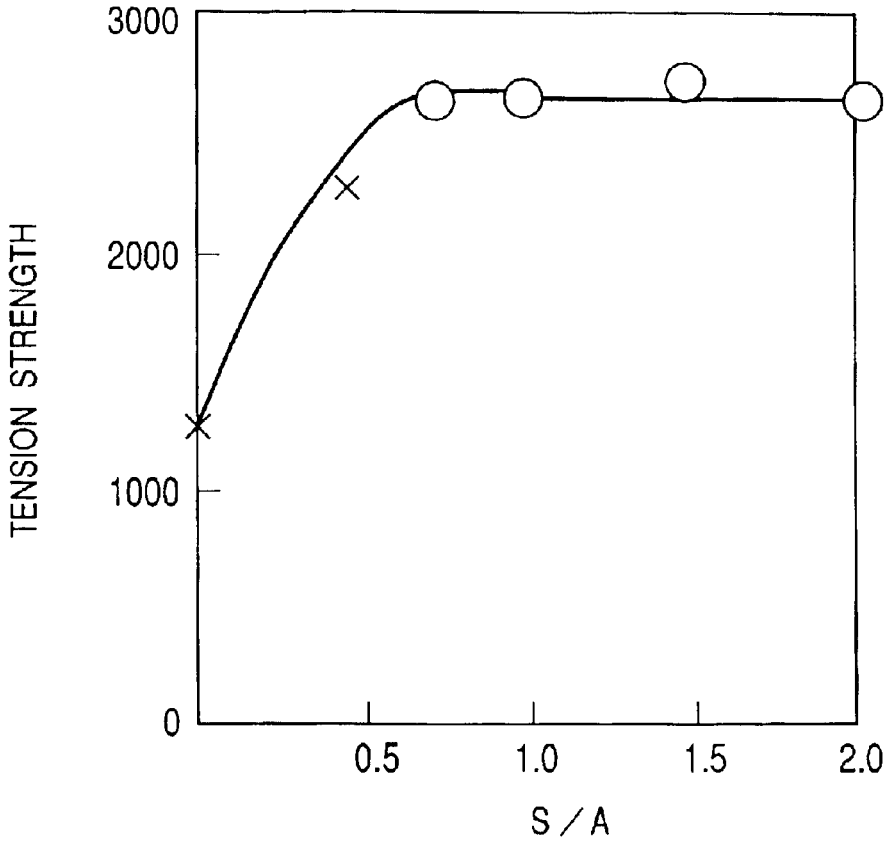
FIG. 5 is a graph representing a relationship between S/A value and a tension strength.

FIG. 5 represents such tensile strength test result, in which symbol "×" shows a case of a spark plug in which the grounding electrode was peeled from the main metal fitting at the welding interface and symbol "○" shows a case of a spark plug in which the grounding electrode was broken at a mother (base) material portion. According to such result, it was found that any peeling was not caused at the welding interface at the S/A value of $0.7 \leqq S/A$ and a necessary welding strength could be ensured.

Figure 6:
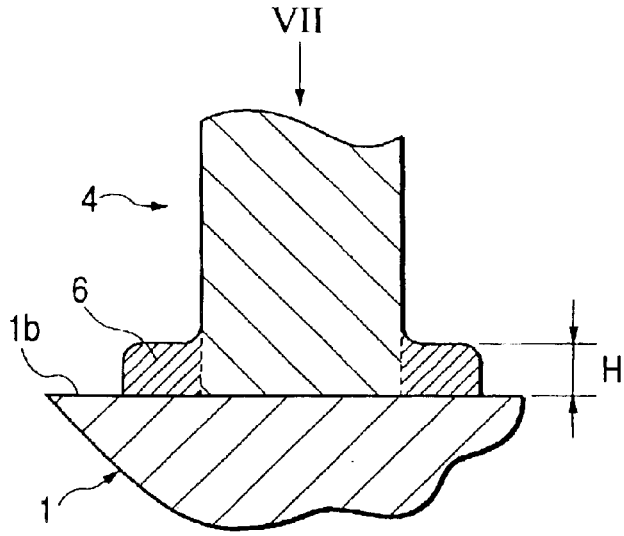
FIG. 6 is a sectional view showing a welded portion of a main metal fitting and a grounding electrode.
Figure 7:
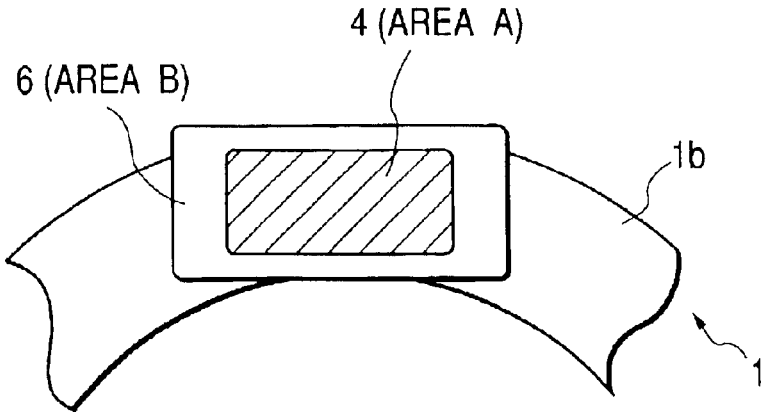
FIG. 7 is a view seen form a direction VII in FIG. 6.

FIG. 6 is a sectional view showing the welded portion of the main metal fitting 1 and the grounding electrode 4 and FIG. 7 is a view seen form the direction VII in FIG. 6. With reference to FIGS. 6 and 7, a welding burr 6, formed by fusing and mixing the mother material of the main metal fitting 1 and the mother material 4 of the grounding electrode 4, is formed at the welding portion thereof. The welding burr 6 has an area wider than the welding end surface 4*c* of the grounding electrode 4. That is, the welding burr 6 expands outside more than the grounding electrode 4 and expands on the end surface 1*b* of the main metal fitting 1 on the grounding electrode side.

As mentioned above, since the welding burr 6 is formed so as to expand outside the grounding electrode 4 on the end surface 1*b* of the main metal fitting 1, an welded area B including the welding burr 6 after the welding becomes necessarily larger than the area A of the grounding electrode 4 on the welding side end. Therefore, even in the case of the area S of the non-plated portion 1*c* is larger than the area A of the welding side end surface 4*c* of the grounding electrode 4, (S>A), the non-plated portion 1*c* can be completely covered by the grounding electrode 4 and the welding burr 6.

However, in a case where the area S of the non-plated portion 1*c* of the main metal fitting 1 is considerably larger than the area A of the welding side end surface 4*c* of the grounding electrode 4, in order to cover the entire surface of the non-plated portion 1*c* with the grounding electrode 4 and the welding burr 6, it is required to make larger (wider) the welding burr 6 by excessively setting the welding condition. However, when the welding burr 6 is excessively formed, the welding burr 6 provides a large height H (FIG. 6), and in the case where this height H exceeds about 1 mm, it was found that a flying spark was easily generated to the welding burr 6.

Figure 8:
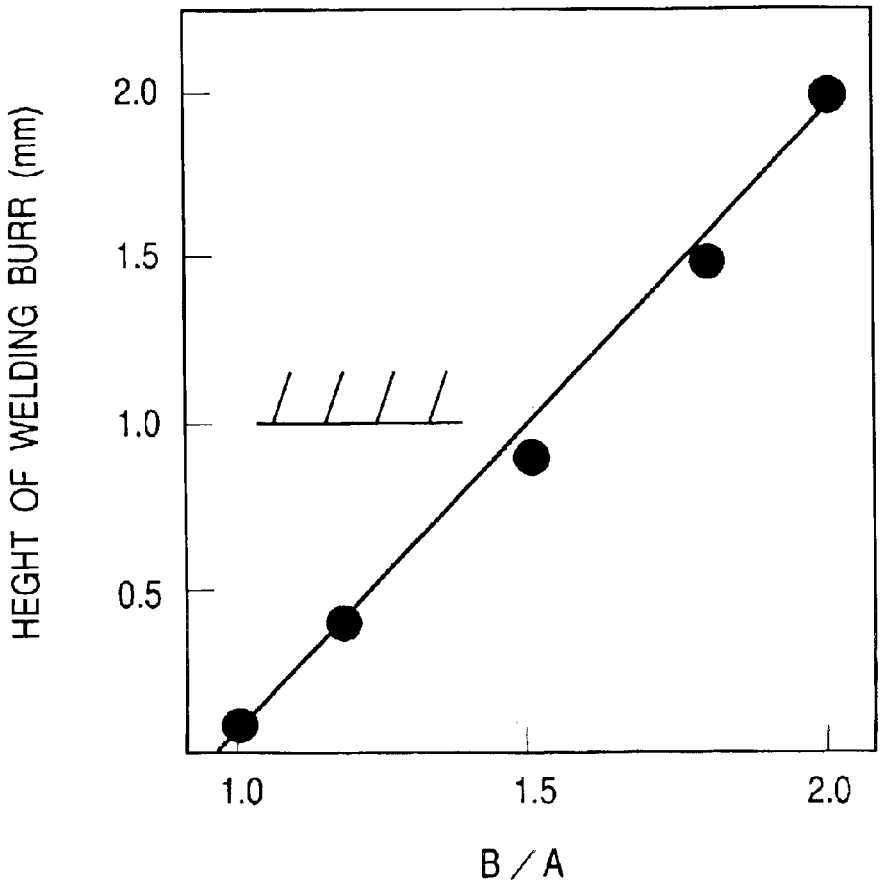
FIG. 8 is a graph representing a relationship between B/A value and a height of welded burr.

The inventor of the subject application then considered the relationship between the height H of the welding burr 6 and the B/A value, and a result represented by FIG. 8 was obtained. With reference to FIG. 8, in the case of the B/A value being less than 1.5, the height H of the welding burr 6 becomes less than 1 mm. Accordingly, by setting the S/A value to $S/A \leqq 1.5$, the non-plated portion 1*c* can be entirely covered by the grounding electrode 4 and the welding burr 6 with the height H of the welding burr 6 being maintained to be less than 1 mm to thereby restrict the occurrence frequency of the flying spark to a range of substantially no problem in the practical use.

Further, in the described embodiment, it is preferred that the grounding electrode 4 is formed from an Ni-base alloy including Cr of more than 10 weight % in the view point of heat-resisting and anti-acid property.

It is also to be noted that the present invention is not limited to the described embodiment and many other changes and modifications may be made without departing from the scopes of the appended claims.

For example, in the described embodiment, although the main metal fitting 1 and the grounding electrode 4 are welded under the oxygen free atmosphere, they may be welded in an atmospheric air, and oxidation discoloring caused at the time of welding in air will be removed, as occasion demands, by means of polishing, for example, after the welding.

Furthermore, in the described embodiment, although the non-plated (plating) portion 1*c* is formed by peeling the plated layer which was once formed to the end surface 1*b* of the main metal fitting 1 after the plating over the outer surface of the main metal fitting 1, such non-plating portion 1*c* may be formed by masking it at the plating time.

Still furthermore, the main metal fitting 1 may be entirely or partially plated except for the non-plated (plating) portion 1*c*.

What is claimed is:

1. A spark plug comprising:

a main metal fitting;

a center electrode mounted to and held by the main metal fitting in a manner insulated therefrom; and a grounding electrode having one end welded to said main metal fitting and another end opposing to said center electrode, wherein a welding burr is formed to the welded portion of the main metal fitting and the grounding electrode so as to have an area expanding outside the grounding electrode, and only said main metal fitting is plated.

2. A spark plug according to claim 1, wherein said main metal fitting is plated at a portion except for said welded portion.

3. A spark plug according to claim 2, wherein said welded portion includes a non-plated portion which is entirely covered by said grounding electrode and said welding burr.

4. A spark plug according to claim 3, wherein said non-plated portion of the main metal fitting is formed by once plating the entire surface of the main metal fitting and then peeling, by polishing, the plated surface of a portion which is welded thereafter to the grounding electrode.

5. A spark plug according to claim 3, wherein said non-plated portion of the main metal fitting is formed by effecting a masking treatment to the main metal fitting.

6. A spark plug according to claim 2, wherein said welded portion includes a non-plated portion and an S/A value is in a range of $0.7 \leqq S/A \leqq 1.5$, where symbol S is an area of the non-plated portion of the main metal fitting and symbol A is an area of the welded side end surface of the grounding electrode.

7. A spark plug according to claim 1, wherein said grounding electrode is formed from an Ni-base alloy.

8. A method of manufacturing a spark plug including a main metal fitting, a center electrode supported by the main metal fitting in a manner insulated therefrom and a grounding electrode having one end to which said main metal fitting is welded and another end opposing to said center electrode, wherein, only said main metal fitting is plated and wherein said main metal fitting is free from plating at a welding portion to be welded to the grounding electrode and said grounding electrode is then welded to the main metal fitting.

9. A method of manufacturing a spark plug according to claim 8, wherein said welding is effected under oxygen free atmosphere.

10. A method of manufacturing a spark plug according to claim 8, wherein said main metal fitting is plated except for said welded portion.

* * * * *